US007527476B2

(12) United States Patent
Butt et al.

(10) Patent No.: US 7,527,476 B2
(45) Date of Patent: May 5, 2009

(54) ROTOR ASSEMBLY AND ANNULUS FILLER FOR GAS TURBINE ENGINE COMPRESSOR

(75) Inventors: David C. Butt, Derby (GB); Kenneth F. Udall, Derby (GB)

(73) Assignee: Rolls-Royce PLC, London (GB)

( * ) Notice: Subject to any disclaimer, the term of this patent is extended or adjusted under 35 U.S.C. 154(b) by 530 days.

(21) Appl. No.: 11/107,927

(22) Filed: Apr. 18, 2005

(65) Prior Publication Data

US 2005/0265847 A1 Dec. 1, 2005

(30) Foreign Application Priority Data

May 28, 2004 (GB) ..... 0411966.5

(51) Int. Cl.
*F01D 5/22* (2006.01)

(52) U.S. Cl. ..... 416/191; 416/193 R; 416/193 A; 416/245 R; 415/174.5

(58) Field of Classification Search ..... 416/191, 416/193 R, 193 A, 196 R, 245 R, 245 A, 416/248; 415/174.5

See application file for complete search history.

(56) References Cited

U.S. PATENT DOCUMENTS

| | | | | |
|---|---|---|---|---|
| 2,873,088 | A * | 2/1959 | Neumann | 416/193 A |
| 3,703,341 | A * | 11/1972 | Garofalo | 416/245 R |
| 3,822,963 | A * | 7/1974 | Goldberg | 416/245 R |
| 4,863,354 | A | 9/1989 | Asselin et al. | |

FOREIGN PATENT DOCUMENTS

| | | |
|---|---|---|
| GB | 586041 | 3/1947 |
| GB | 2 364 748 A | 2/2002 |

* cited by examiner

*Primary Examiner*—Christopher Verdier
(74) *Attorney, Agent, or Firm*—Oliff & Berridge, PLC

(57) ABSTRACT

A rotor assembly for a gas turbine engine compressor includes a rotor disc for mounting a plurality of radially extending rotor blades for rotation thereon, an annulus filler for securing to the disc to provide a radially inner airflow surface for air passing through the rotor assembly and a securing arrangement for securing the annulus filler to the rotor disc, the annulus filler being configured such that it is biased into a condition in which the securing arrangement mechanically retains the annulus filler on the disc, but is movable against its bias to allow the annulus filler to be removed from the disc.

30 Claims, 3 Drawing Sheets

ROTOR ASSEMBLY AND ANNULUS FILLER FOR GAS TURBINE ENGINE COMPRESSOR

The invention relates to a rotor assembly for a gas turbine engine compressor, and particularly to a rotor assembly for a low pressure compressor or fan of a gas turbine engine. The invention also relates to an annulus filler for a gas turbine engine compressor rotor assembly.

A compressor for a gas turbine engine includes at least one rotor assembly including a rotor disc having an array of rotor blades mounted thereon. The rotor blades extend radially outwardly from the disc and may be rotated to draw air through the rotor assembly, the air passing through an annular area (the "rotor air annulus") defined between the rotor disc and an outer casing surrounding the tips of the rotor blades.

It is important that the rotor air annulus has a smooth radially inner surface for air to flow over as it passes through the rotor assembly. One way of ensuring this is to produce rotor blades with integral platforms, the platforms forming an inner wall of the rotor air annulus in use. The blade and platform are manufactured as a single unit from a common material. An alternative practice is to use "annulus fillers". The annulus fillers are located between adjacent rotor blades and include a smooth radially outer surface which constitutes or forms part of the inner wall of the rotor air annulus in use. Annulus fillers may be manufactured from relatively light-weight materials and, in the event of damage, may be replaced independently of the rotor blades.

It is known to provide annulus fillers with features for removably attaching them to the rotor disc. An annulus filler may be provided with a hook member at its axially rear end, the hook member sliding into engagement with part of the rotor disc and/or a component located axially behind the rotor assembly, for example a rear fan air seal. Typically, each annulus filler is slid axially backwards to cause the hook member to engage, and then retained in place by a front attachment disc which is fastened over the fronts of all the annulus fillers located around the rotor disc. The front attachment disc may be bolted into place and this may also hold the nose cone in place at a front of the engine.

It is often necessary to remove fan blades and annulus fillers to check for cracks in the blades or to replace damaged components. In the prior art design, in order to remove an annulus filler, it is necessary to remove the nose cone and the front attachment disc before the annulus filler can be removed. This is relatively complex and time consuming.

According to the invention there is provided a rotor assembly for a gas turbine engine compressor, the rotor assembly including:

a rotor disc for mounting a plurality of radially extending rotor blades such that rotation of the blades draws air through the rotor assembly; and an annulus filler for securing to the disc to provide a radially inner airflow surface for air being drawn through the rotor assembly;

characterised in that:

the rotor assembly includes a securing arrangement for securing the annulus filler to the rotor disc, and the annulus filler is configured such that it is biased into a condition in which the securing arrangement mechanically retains the annulus filler on the disc, but is movable against the bias to allow the annulus filler to be removed from the disc.

The annulus filler may include an axially forward end and an axially rear end, its airflow surface extending substantially between the forward and the rear end.

The securing arrangement may include a first retaining means provided at the forward end of the annulus filler, and a second retaining means provided at the rear end of the annulus filler.

The first retaining means may include a hook member provided on the forward end of the annulus filler, and a recess provided in the rotor disc, the hook member being shaped to engage the recess. The hook member may extend from the remainder of the annulus filler in a forward and radially outward direction.

The second retaining means may also include a hook member, provided on the rear end of the annulus filler, for engaging a complementary formation provided in the rotor disc or in an adjacent part. The hook member may be biased into a position where it is in engagement with the formation.

The annulus filler may include a resilient portion which provides the bias for the securing arrangement. The resilient portion may comprise a springy piece of material which forms part of the annulus filler. The annulus filler may be shaped such that when the springy piece of material is compressed, the hook member of the second retaining means may be brought out of engagement with its complementary formation.

The rotor disc and the annulus filler may be profiled such that together their radially outer surfaces form a smooth airflow surface for air being drawn through the rotor assembly. The rotor disc may form an axially forward part of that airflow surface and the annulus filler an axially rearward part.

The annulus filler may include an outer wall which forms part of the airflow surface and an inner wall which locates adjacent the disc. The area between the outer and inner wall may be substantially hollow but may include a triangulated structure for additional strength.

The resilient portion of the annulus filler may comprise a leg extending from the inner wall of the annulus filler. The leg may be oriented at an acute angle to the inner wall. The resilience of the leg may allow it to be pushed towards the inner wall, thus reducing this angle.

The annulus filler may comprise an extrusion. The annulus filler may be made of aluminium.

In one embodiment of the invention, the second retaining means includes a hook member provided at a radially outer part of the rear of the annulus filler, for engagement with a recess in a fan rear air seal. The hook member and recess may be so shaped that inwards movement of the hook member allows it to be brought out of engagement with the recess, preferably by manually bringing it forwards. The hook member may be located on an arm which forms part of the annulus filler, the resilience of the material of the annulus filler allowing some flexing of the arm. The arm may flex about its proximal end, this being located in a radially inner region of the annulus filler.

In this embodiment, the resilient portion of the annulus filler may comprise a springy leg extending from the inner wall of the annulus filler, the leg biasing the annulus filler radially outwardly. Radially inwards movement of the annulus filler against the bias of the leg may thereby allow the hook member to be disengaged from the recess. The outer wall of the annulus filler may include an opening adjacent to the hook member of the second retaining means, to allow space for the hook member to move forwards.

The annulus filler may be shaped such that once the second retaining means has been released, the annulus filler may be pivoted about the first retaining means, allowing the hook member of the first retaining means to be released from its associated recess.

In an alternative embodiment, the second retaining means includes a hook member provided at a radially inner part of the rear of the annulus filler, the hook member engaging a complementary formation on the rotor disc. The hook member and the formation may be shaped such that radially inwards movement of the hook member allows it to be brought out of engagement with the formation, preferably by moving the hook member rearwards. The hook member may be located on an arm formed as part of the annulus filler, the resilience of the material of the annulus filler allowing some flexing of the arm. The arm may flex about its proximal end, this being located in a radially mid region of the annulus filler.

In this embodiment, the resilient portion of the annulus filler may again comprise a springy leg extending from the inner wall of the annulus filler, the leg biasing the annulus filler radially outwards.

According to the invention there is provided an annulus filler for securing to a rotor disc of a rotor assembly according to any preceding, embodiment, the annulus filler in use providing a radially inner airflow surface for air being drawn through the rotor assembly of the gas turbine engine, the annulus filler including retaining means forming part of the securing arrangement for securing the annulus filler to the rotor disc and the annulus filler being configured such that it is biased into a condition in which the securing arrangement mechanically retains the annulus filler on the disc but is movable against the bias to allow the annulus filler to be removed from the disc.

The annulus filler may include any of the additional features defined in the preceding paragraphs.

An embodiment of the invention will be described for the purpose of illustration only with reference to the accompanying drawings in which:—

Figure 1:
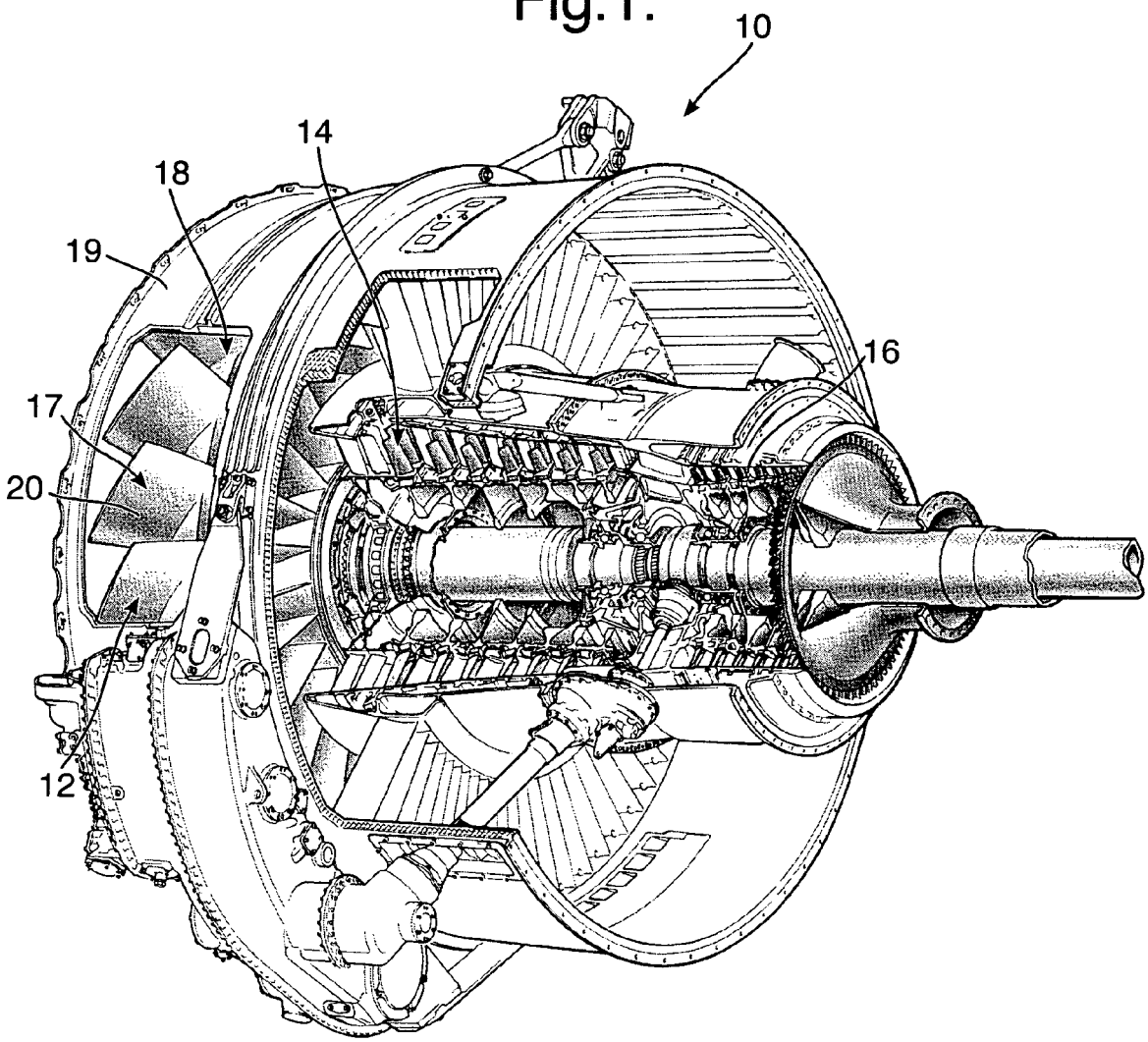
FIG. 1 is a diagrammatic perspective part cut-away illustration of an axial flow compressor for a gas turbine engine.

Referring to FIG. 1, there is shown an axial flow compressor 10 of a gas turbine engine including low pressure, intermediate pressure and high pressure compressors 12, 14 and 16 respectively. The low pressure compressor 12 may alternatively be referred to as a fan. Each fan/compressor includes at least one rotor assembly 17 comprising a rotor disc 18 on which are mounted a plurality of rotor blades 20. The rotor blades 20 extend radially outwardly from the rotor disc 18 and may be rotated to draw air through the compressor, the air being compressed further as it passes sequentially through the low, intermediate and high pressure compressors. The air passes through a rotor air annulus, defined between the rotor disc 18 and a casing 19 which surrounds the radially outer tips of the blades 20.

Figure 2:
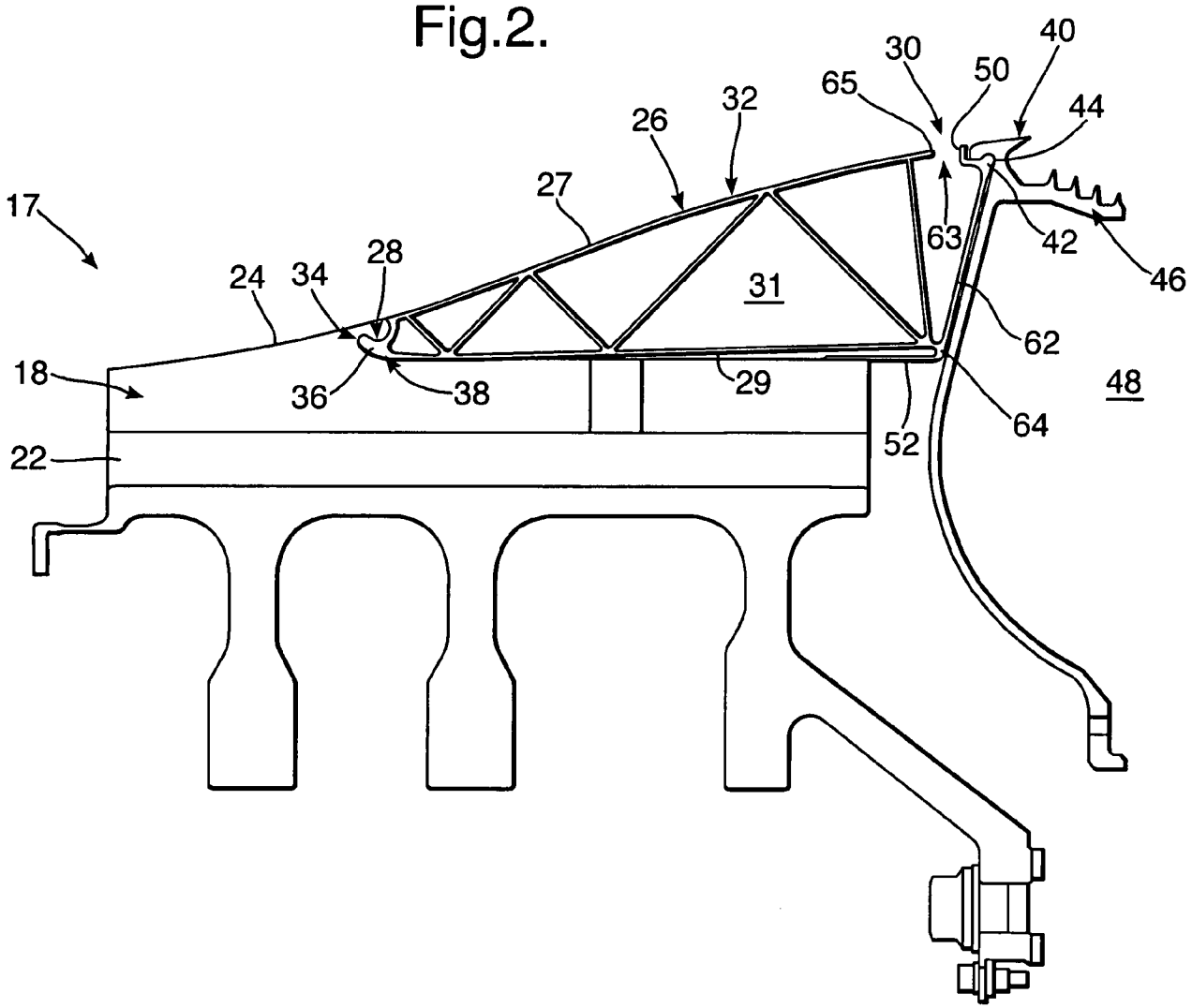
FIG. 2 is a diagrammatic sectional view of an annulus filler according to a first embodiment of the invention, in place on a rotor disc.

Referring to FIG. 2, a rotor assembly 17 for the fan 12 comprises a rotor disc 18 on which rotor blades (not illustrated) may be mounted in known fashion. Each blade includes a root portion which may be slid axially into a slot 22 provided within the rotor disc 18.

The blades are spaced apart on the rotor disc 18, and a leading part of the space between each two adjacent blades is bridged by a portion 24 of the rotor disc 18. By "leading" it is meant the part of the rotor assembly through which air passes first. A rear part of the space between each two adjacent blades is bridged by an annulus filler 26. The annulus filler 26 thus occupies only part of the space between the blades, but in some cases could also occupy the forward region 24. The term "annulus filler" as used herein is intended to cover both complete and partial or "mini" fillers (i.e. annulus fillers which occupy the whole or part of the space between the blades).

The leading portion 24 of the disc 18, together with the annulus filler 26, form a smooth inner surface of the rotor air annulus, as described in more detail below.

The annulus filler 26 includes an axially forward end 28, an axially rear end 30 and an airflow surface 32 which extends substantially between the forward and the rear end.

The annulus filler includes an outer wall 27 which provides the smooth airflow surface and an inner wall 29 which locates adjacent to the disc 18. An area 31 between the inner wall and the outer wall may be substantially hollow or may be triangulated for additional strength.

The annulus filler 26 is secured to the rotor disc 18 by means of a securing arrangement. The annulus filler is configured such that it is biased into a condition in which the securing arrangement mechanically retains the annulus filler on the disc. However, the annulus filler may be moved against its bias to allow the annulus filler to be removed from the disc 18.

The securing arrangement includes a first retaining means 34 provided at the forward end 28 of the annulus filler 26. The first retaining means includes a hook member 36 which extends smoothly forwards and slightly radially outwards from the forward end 28 of the annulus filler 26.

The hook member 36 may fit into a complementary recess 38 formed in the rotor disc 18. It may be seen that the hook member 36 may be brought into full engagement with the recess 38 by a combination of forwards and rotational movement of the annulus filler relative to the rotor disc 18.

The securing arrangement further includes a second retaining means 40 provided at the rear end 30 of the annulus filler 26. The second retaining means also includes a hook member 42 which is able to fit into a complementary formation 44 in a rear fan air seal 46. The rear fan air seal 46 locates just behind the rotor disc 18 and separates higher pressure air in a region 48 from the fan region. The rear fan air seal 46 is typically made of titanium. The hook member 42 and the complementary formation 44 are shaped such that radially inwards movement of the hook member 42 allows the hook member to be released from the formation 44 by manually bringing it an axially forward direction. A tab 50 attached to the hook member 42 is provided to allow for this manual manipulation.

The hook member 42 is biased into a radially outwards position in which it is retained in engagement with the formation 44. The biasing is provided by a resilient portion of the annulus filler in the form of a springy leg 52. The springy leg 52 extends from the inner wall 29 of the annulus filler.

The springy leg 52 biases the rear end 30 of the annulus filler 26 radially outwardly, thus retaining the hook member 42 in engagement with the formation 44.

The hook member 44 is located on a distal end of an arm 62 which is only attached to the remainder of the annulus filler 26 at a pivot point 64. There is a space 63 between the distal end of the arm 62 and an adjacent part 65 of the outer wall 27.

To disengage the second retaining means, the rear end 30 of the annulus filler 26 may be pushed radially inwardly against the bias of the springy leg 52. With the rear end 30 in this slightly radially inner position, the tab 50 may be manipulated to bring the hook member 42 forwards into the space 63, pivoting the arm 62 about the pivot point 64. This allows the hook member 42 to be brought out of engagement with the formation 44.

Figure 3:
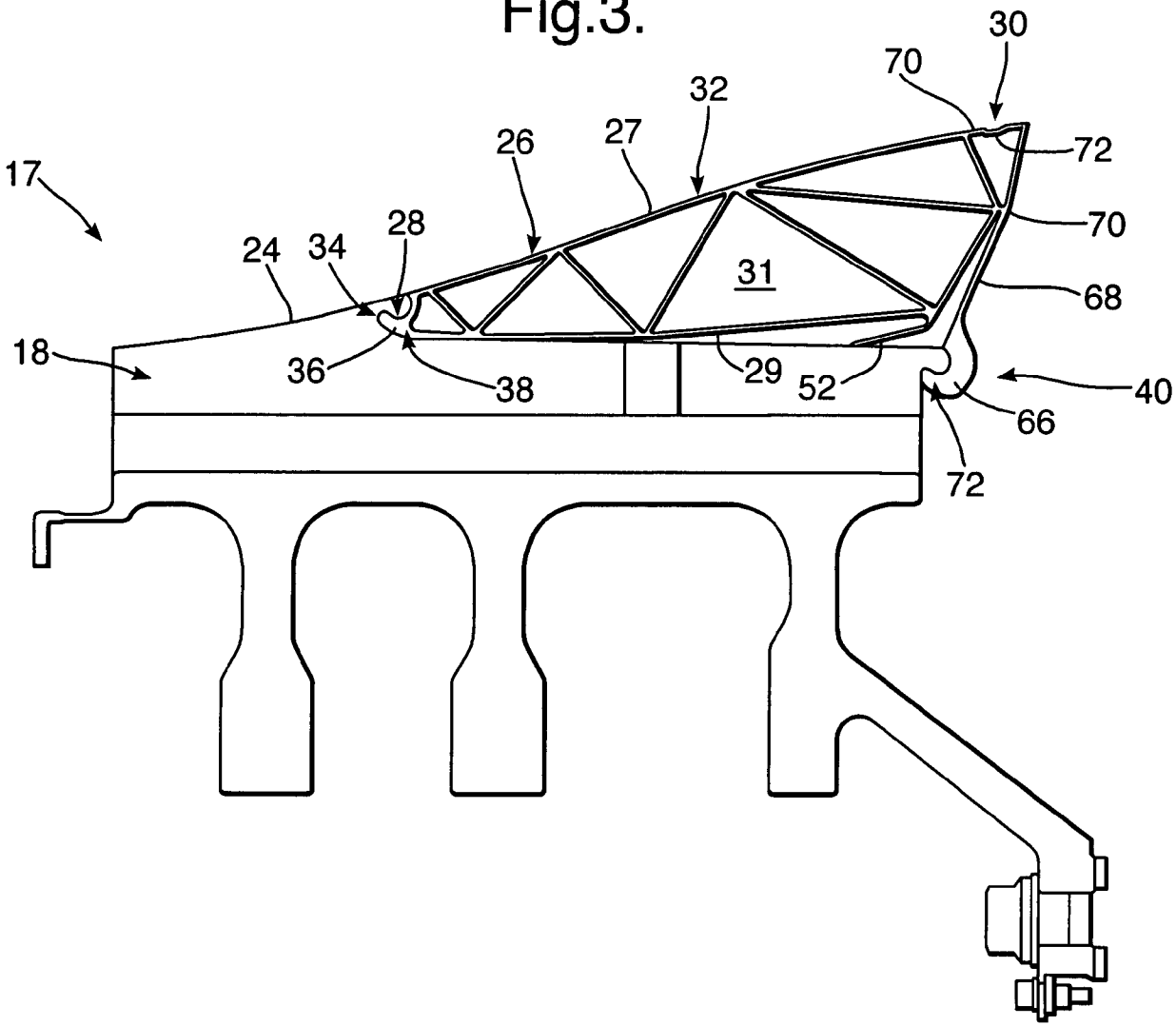
FIG. 3 is an annulus filler according to a second embodiment of the invention in place of a rotor disc.

The space 63 may be partially sealed against the annulus air in a similar manner to that shown in FIG. 3.

The whole annulus filler may then be rotated slightly in an anti-clockwise direction as viewed in FIG. 2 allowing the hook member 36 of the first retaining means to be removed from the recess 38, thereby freeing the annulus filler from the rotor disc 18.

Referring to FIG. 3, there is illustrated an alternative embodiment of the invention in which corresponding parts are given the same reference numerals.

The annulus filler 26 of the FIG. 3 embodiment is generally similar to that described previously. In particular, the first retaining means 34 includes a hook member 36 and a complementary recess 38 as described previously. The second retaining means 40 differs in that the rear end 30 of the filler is provided with a hook member 66 mounted on an arm 68 which extends radially inwardly from a pivot point 70. The arm therefore extends radially inwardly rather than radially outwardly as in the last embodiment. The hook member 66 is able to engage a complementary formation 72 provided on the rotor disc 18.

Again, the resilient portion of the annulus filler comprises a springy leg 52 which extends away from the inner wall of the annulus filler at an acute angle.

In this embodiment, to release the annulus filler 26 from the rotor disc 18, the rear end 30 of the annulus filler may again be pushed radially inwardly against the resilience of the springy leg 52. This allows the arm 62 to be pivoted in an anti-clockwise direction as viewed in FIG. 3, thereby releasing the hook member 66 from the complementary formation 68. Opposite the hook member 66, the outer wall 27 of the annulus filler 26 is shaped to allow a part 70 of the outer wall to slide over an adjacent part 72, to allow the pivotal movement of the arm 62. Once the hook member 66 of the second retaining means has been released, the annulus filler may be rotated anti-clockwise and the hook member 36 of the first retaining means 34 may be released from the recess 38, thereby releasing the annulus filler 26 from the rotor disc 18.

The annulus filler may be an extrusion. It may be manufactured by extruding lengthwise, and then cut up into appropriate lengths which are subsequently bent to accommodate the curved shape of the rotor disc 18. The extrusion may be aluminium.

As an alternative, it may be possible to use injection moulded plastics materials, as this area of the engine does not get very hot and no significant strength is required.

The annulus fillers according to the preferred embodiments of the invention are very easy to remove. Whereas in the prior art it was necessary to remove the nose cone and the front attachment disc in order to remove the annulus fillers, in the preferred embodiments of the invention, the annulus fillers may simply be snapped into and out of place as described above. The annulus fillers are therefore much quicker to remove. Further, the annulus fillers should be cheaper to manufacture than in the prior art.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A rotor assembly for a gas turbine engine compressor, the rotor assembly having a rotational axis and including:

a rotor disc for mounting a plurality of radially extending rotor blades such that rotation of the rotor blades draws air through the rotor assembly; and an annulus filler being disposed on a circular surface of rotor disc to provide a radially inner airflow surface for air being drawn through the rotor assembly, wherein the rotor assembly includes a securing arrangement for securing the annulus filler to the circular surface of the rotor disc, and the annulus filler includes a resilient portion such that the annulus filler is radially outwardly biased relative to the rotational axis into a condition in which the securing arrangement mechanically retains the annulus filler on the circular surface of the rotor disc, but is movable against the bias to allow the annulus filler to be removed from the rotor disc, the annulus filler includes an axially forward end and an axially rear end, the airflow surface of the annulus filler extending substantially between the forward and the rear end, and the securing arrangement includes a forward retaining means provided at the forward end of the annulus filler, and a rear retaining means provided at the rear end of the annulus filler.

2. A rotor assembly according to claim 1, wherein the forward retaining means includes a forward hook member provided on the forward end of the annulus filler, and a recess provided in the rotor disc, the forward hook member being shaped to engage the recess.

3. A rotor assembly according to claim 2, wherein the forward hook member extends from the remainder of the annulus filler in a forward and radially outward direction.

4. A rotor assembly according to claim 1, wherein the rear retaining means includes a rear hook member, provided on the rear end of the annulus filler, for engaging a complementary formation provided in the rotor disc or in an adjacent part.

5. A rotor assembly according to claim 4, wherein the rear hook member is biased into a position where the rear hook member is in engagement with the formation

6. A rotor assembly according to claim 1 wherein the resilient portion comprises a springy piece of material which forms part of the annulus filler.

7. A rotor assembly according to claim 6, wherein the securing arrangement includes a rear hook member provided on a rear end of the securing arrangement and the annulus filler is shaped such that when the springy piece of material is compressed, the rear hook member may be brought out of engagement with a complementary formation provided in the rotor disc or in an adjacent part.

8. A rotor assembly according to claim 1, wherein the rotor disc and the annulus filler are profiled such that together their radially outer surfaces form a smooth airflow surface for air being drawn through the rotor assembly.

9. A rotor assembly according to claim 8, wherein the rotor disc forms an axially forward part of the airflow surface and the annulus filler forms an axially rearward part of the airflow surface.

10. A rotor assembly according to claim 9, wherein the annulus filler includes an outer wall which forms part of the airflow surface and an inner wall which is located adjacent the rotor disc.

11. A rotor assembly according to claim 10, wherein the area between the outer and inner wall is substantially hollow but includes a triangulated structure for additional strength.

12. A rotor assembly according to claim 10, wherein the resilient portion of the annulus filler comprises a leg extending from the inner wall of the annulus filler.

13. A rotor assembly according to claim 12, wherein the leg is oriented at an acute angle to the inner wall.

14. A rotor assembly according to claim 13, wherein the resilience of the leg allows the leg to be pushed towards the inner wall, thus reducing this angle.

15. A rotor assembly according to claim 1, wherein the annulus filler comprises an extrusion.

16. A rotor assembly according to claim 15, wherein the annulus filler is made of aluminium.

17. A rotor assembly according to claim 1, wherein the rear retaining means includes a rear hook member provided at a radially outer part of the rear of the annulus filler, for engagement with a recess in a fan rear air seal.

18. A rotor assembly according to claim 17, wherein the rear hook member and recess are so shaped that inwards movement of the rear hook member allows the rear hook member to be brought out of engagement with the recess, by manually bringing the rear hook member forwards.

19. A rotor assembly according to claim 17, wherein the rear hook member is located on an arm which forms part of the annulus filler, a resilience of a material of the annulus filler allowing some flexing of the arm.

20. A rotor assembly according to claim 19, wherein the arm may flex about a proximal end of the arm, the proximal end being located in a radially inner region of the annulus filler.

21. A rotor assembly according to claim 18, wherein the resilient portion of the annulus filler comprises a springy leg extending from an inner wall of the annulus filler which is located adjacent the rotor disc, the leg biasing the annulus filler radially outwardly.

22. A rotor assembly according to claim 21, wherein radially inwards movement of the annulus filler against the bias of the leg thereby allows the hook member to be disengaged from the recess.

23. A rotor assembly according to claim 22, wherein an outer wall of the annulus filler which forms part of the airflow surface includes an opening adjacent to the rear hook member, to allow space for the rear hook member to move forwards, the opening being optionally sealed by forward extension of an arm which forms part of the annulus filler.

24. A rotor assembly according to claim 23, wherein the annulus filler is shaped such that once the rear retaining means has been released, the annulus filler may be pivoted about the forward retaining means provided at the forward end of the annulus filler, allowing a forward hook member provided on the forward end of the annulus filler to be released from a recess formed in the rotor disc.

25. A rotor assembly according to claim 1, wherein the rear retaining means provided at the rear end of the annulus filler includes a rear hook member provided at a radially inner part of the rear of the annulus filler, the rear hook member engaging a complementary formation on the rotor disc.

26. A rotor assembly according to claim 25, wherein the rear hook member and the formation are shaped such that radially inwards movement of the rear hook member allows the rear hook member to be brought out of engagement with the formation, by moving the rear hook member rearwards.

27. A rotor assembly according to claim 26, wherein the rear hook member is located on an arm formed as part of the annulus filler, a resilience of a material of the annulus filler allowing some flexing of the arm.

28. A rotor assembly according to claim 27, wherein the arm flexes about a proximal end of the arm, the proximal end being located in a radially mid region of the annulus filler.

29. A rotor assembly according to claim 25, wherein the resilient portion of the annulus filler comprises a springy leg extending from an inner wall of the annulus filler which is located adjacent the rotor disc, the leg biasing the annulus filler radially outwards.

30. An annulus filler for securing to a rotor disc of a rotor assembly for a gas turbine engine compressor, the rotor assembly having a rotational axis, and a securing arrangement including a forward retaining means and a rear retaining means, the annulus filler comprising:

retaining means forming part of the securing arrangement for securing the annulus filler to a circular surface of the rotor disc, the annulus filler being disposed on the circular surface;

a resilient portion such that the annulus filler is radially outwardly biased relative to the rotational axis into a condition in which the securing arrangement mechanically retains the armulus filler on the circular surface of the rotor disc but is movable against the bias to allow the annulus filler to be removed from the rotor disc;

an axially forward end;

an axially rear end; and an airflow surface extending substantially between the forward and the rear end, wherein the forward retaining means is provided at the forward end, and the rear retaining means is provided at the rear end.

* * * * *